US009403254B2

(12) United States Patent
Hwang et al.

(10) Patent No.: US 9,403,254 B2
(45) Date of Patent: Aug. 2, 2016

(54) METHODS FOR REAL-TIME ERROR DETECTION IN CMP PROCESSING

(75) Inventors: James Jeng-Jyi Hwang, Chu-Tong Town (TW); Bo-I Lee, Sindian (TW); Chi-Ming Yang, Hsin-Chu (TW); Chin-Hsiang Lin, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 940 days.

(21) Appl. No.: 13/211,847

(22) Filed: Aug. 17, 2011

(65) Prior Publication Data

US 2013/0044004 A1 Feb. 21, 2013

(51) Int. Cl.

| | |
|---|---|
| ***B24B 37/005*** | (2012.01) |
| ***B24B 37/04*** | (2012.01) |
| ***B24B 37/10*** | (2012.01) |
| ***B24B 49/00*** | (2012.01) |
| ***B24B 49/10*** | (2006.01) |
| ***B24B 49/14*** | (2006.01) |

(52) U.S. Cl.

CPC ..... *B24B 37/005* (2013.01); *B24B 37/042* (2013.01); *B24B 37/107* (2013.01); *B24B 49/003* (2013.01); *B24B 49/10* (2013.01); *B24B 49/14* (2013.01)

(58) Field of Classification Search

CPC .... B24B 29/00; B24B 49/003; B24B 37/042; B24B 37/005; B24B 51/00; B24B 7/228

USPC ..... 340/679; 438/5; 451/5, 8, 21, 41, 56, 451/59, 63

See application file for complete search history.

(56) References Cited

U.S. PATENT DOCUMENTS 5,008,841 A * 4/1991 McElroy ..... F16K 37/0083 137/553
5,045,669 A * 9/1991 Ortiz, Jr. ..... B23K 26/032 219/121.61
5,399,234 A 3/1995 Yu et al.

(Continued)

FOREIGN PATENT DOCUMENTS

CN 101996479 3/2011
JP 2008-093742 4/2008

(Continued)

OTHER PUBLICATIONS

Korean Office Action of Korean Application No. 10-2011-0110755, dated Oct. 19, 2012, with translation, 9 pages.

*Primary Examiner* — Timothy V Eley
(74) *Attorney, Agent, or Firm* — Slater Matsil, LLP

(57) ABSTRACT

Methods and apparatus for detecting errors in real time in CMP processing. A method includes disposing a semiconductor wafer onto a wafer carrier in a tool for chemical mechanical polishing ("CMP"); positioning the wafer carrier so that a surface of the semiconductor wafer contacts a polishing pad mounted on a rotating platen; dispensing an abrasive slurry onto the rotating polishing pad while maintaining the surface of the semiconductor wafer in contact with the polishing pad to perform a CMP process on the semiconductor wafer; in real time, receiving signals from the CMP tool into a signal analyzer, the signals corresponding to vibration, acoustics, temperature, or pressure; and comparing the received signals from the CMP tool to expected received signals for normal processing by the CMP tool; outputting a result of the comparing. A CMP tool apparatus is disclosed.

18 Claims, 8 Drawing Sheets

(56) References Cited

U.S. PATENT DOCUMENTS

| | | | | |
|---|---|---|---|---|
| 5,876,265 | A | 3/1999 | Kojima | |
| 6,042,454 | A * | 3/2000 | Watanabe et al. | 451/6 |
| 6,424,137 | B1 * | 7/2002 | Sampson | 324/76.21 |
| 6,572,441 | B2 * | 6/2003 | Lukner et al. | 451/5 |
| 6,585,562 | B2 * | 7/2003 | Gitis et al. | 451/5 |
| 6,937,915 | B1 * | 8/2005 | Kistler et al. | 700/121 |
| 6,997,778 | B2 * | 2/2006 | Ono et al. | 451/8 |
| 7,016,799 | B2 * | 3/2006 | Dondi | B24B 49/003 451/1 |
| 7,163,435 | B2 * | 1/2007 | Lim et al. | 451/5 |
| 7,294,041 | B1 * | 11/2007 | Lee et al. | 451/8 |
| 7,377,170 | B2 * | 5/2008 | Ganesan et al. | 73/587 |
| 2002/0182978 | A1 | 12/2002 | Lukner et al. | |
| 2005/0054268 | A1 * | 3/2005 | Kistler et al. | 451/5 |
| 2005/0125202 | A1 * | 6/2005 | Gotkis et al. | 702/193 |
| 2011/0035186 | A1 | 2/2011 | Liu et al. | |
| 2014/0329439 | A1 * | 11/2014 | Chew | B24B 37/0053 451/5 |
| 2014/0350354 | A1 * | 11/2014 | Stenzler | A61B 5/4818 600/301 |
| 2015/0285927 | A1 * | 10/2015 | Nedilko | B61K 9/08 702/2 |
| 2015/0305687 | A1 * | 10/2015 | Schmidt | A61B 7/04 600/528 |
| 2015/0309196 | A1 * | 10/2015 | Yang | E21B 47/16 367/30 |

FOREIGN PATENT DOCUMENTS

| | | |
|---|---|---|
| JP | 2010-093058 | 4/2010 |
| WO | WO 2010-004516 A1 | 4/2010 |

* cited by examiner

81

METHODS FOR REAL-TIME ERROR DETECTION IN CMP PROCESSING

BACKGROUND

Chemical mechanical polishing ("CMP") is commonly used in current advanced semiconductor processing. In CMP a rotating pad receives abrasive slurry. The pad is mounted on a platen and typically oriented in a face up arrangement. A wafer carrier is moved downward towards the pad. The wafer carrier may rotate about a central axis and may oscillate. A vacuum or electrostatic force may be used to mount a semiconductor wafer is to the carrier. The wafer carrier is positioned so that the face of the semiconductor wafer contacts the polishing pad and the slurry. The wafer and carrier may also rotate and oscillate during the polishing process. The wafer may have a dielectric layer that requires planarization, for example. In other process steps, for example for damascene metal fabrication, CMP can be used to remove excess metal and planarize the upper surface of plated metal conductors and the surrounding dielectric, to form inlaid metal conductors within the dielectric layers. By abrasively polishing the surface of the semiconductor wafer, asperities in layers can be removed to planarize the layer. Excess material may be removed as well.

During CMP processing of a surface, particles are sometimes generated. If a hard particle gets trapped on the wafer surface between the wafer and the CMP polishing pad, wafer scratching can occur. The scratches can cause defects in the integrated circuit devices that are being manufactured on the wafer and result in a loss of these devices. The wafer scratches are often not detected until the wafer processing reaches a later stage where some scan or visual inspection is done. The scratch detection may happen after many more processing steps are performed. Currently there is no mechanism for detecting wafer scratches as they occur during the CMP process. This leads to many wasted steps and loss of materials and time.

A continuing need thus exists for methods and apparatus for detecting wafer scratching problems or other errors in CMP processes without the disadvantages currently experienced using known methods.

BRIEF DESCRIPTION OF THE FIGURES

For a more complete understanding of the present invention, and the advantages thereof, reference is now made to the following descriptions taken in conjunction with the accompanying drawings, in which.

Figure 1:
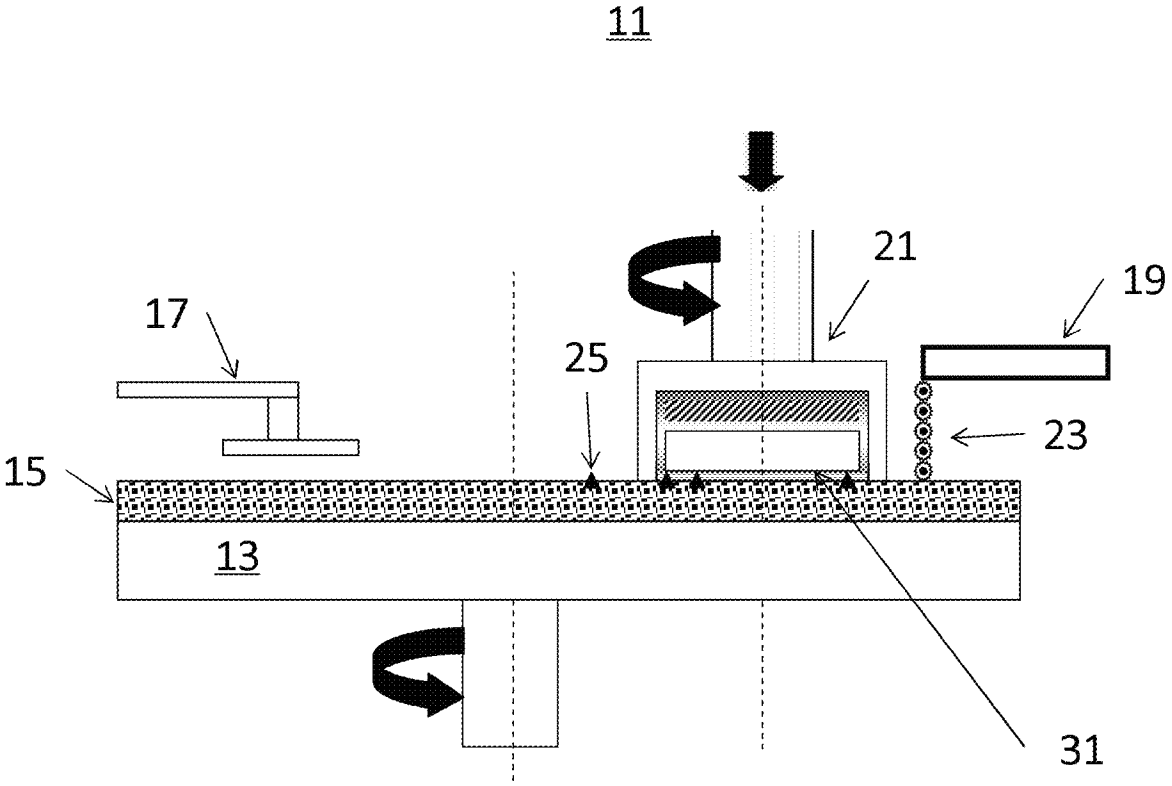
FIG. 1 depicts in a cross-sectional view a CMP tool compatible with the embodiments.

The drawings, schematics and diagrams are illustrative and not intended to be limiting, but are examples of embodiments of the invention, are simplified for explanatory purposes, and are not drawn to scale.

DETAILED DESCRIPTION

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Embodiments of the present application which are now described in detail provide novel methods and apparatus for manufacturing semiconductor devices including performing chemical mechanical polishing on layers while detecting unusual vibration. The vibration is monitored during processing in real time and unusual vibration may be used to detect an unexpected condition during polishing. For example hard particles between the wafer and the CMP pad can cause vibration that is different from and therefore detectable from normal vibration patterns during polishing. An alarm or message signal can be sent; and further the CMP processing can be stopped either manually or automatically with the alarm. In this manner scratches or other defects can be remedied, or processing stopped, saving materials and time that would have otherwise been expended on processing a wafer that may not yield completed devices. Importantly the embodiments provide real time monitoring of a CMP process which avoids continuing damage to numerous wafers; in contrast to the conventional methods.

Current semiconductor processing often uses CMP processes. Without limiting the embodiments, example processing steps for CMP are to remove materials, to planarize deposited layers or even wafer surfaces, and to pattern and remove excess electroplated metal conductors in damascene processes, for example. In one example CMP process, shallow trench isolation regions ("STI") may be formed by etching trenches into a semiconductor substrate. Dielectric may be deposited in the trenches to form the STI regions. In forming the STI regions, the dielectric is deposited until the trenches are filled and then overfilled, so that the excess dielectric forms a layer over the substrate. A CMP polishing step is then performed to planarize the STI regions and the substrate; and the result is that the tops of the STI regions are left coplanar with the surface of the semiconductor substrate.

Interlevel dielectric ("ILD") layers may be formed over planar transistors disposed on the substrate, for example. The ILD dielectric is conformally deposited and thus portions of the ILD that are formed over a higher structure, such as over the gate conductor, will result in a correspondingly higher portion of the deposited ILD. Again a CMP process may be performed to polish the ILD layer and remove the high portions, thus planarizing the ILD layer; forming a planar surface needed or desirable for additional processing steps.

Metal layers for conductors are typically formed in single or dual damascene processing steps. First level metal or "M1" layer conductors may be formed from a single damascene copper or copper alloy, aluminum or other conductor. The copper is electroplated into a trench within a dielectric layer. During electroplating the copper fills and then overfills the trench. Because chemical etchants and other etch processes are ineffective in patterning copper, another chemical mechanical polishing process is used with an abrasive slurry and a pad to mechanically remove the excess copper. An inlaid conductor is the result, formed within the trench and surrounded by the dielectric layer. The finished conductor has a polished upper surface that is coplanar with a surface of the surrounding dielectric.

Accordingly, CMP processing is used repeatedly in semiconductor processing to form integrated circuits on semiconductor substrates. FIG. 1 depicts in a cross-section a conventional CMP processing tool 11, depicted here for explanatory purposes. In FIG. 1, a rotating platen 13 is provided with a polishing pad 15 overlying it. The pad 15 receives a slurry 23, which is typically an abrasive compound and a fluid such as deionized water, or a liquid cleaner such as KOH, continuously supplied from a slurry source 19. A pad conditioner 17 is provided on a movable arm. The pad conditioner 17 operates to restore asperities to the pad 15, even as the wafer polishing process wears down and makes the pad smooth. That is, in order to retain the material removal qualities of the CMP pad 15, pad conditioner 17 is used to maintain some roughness on the surface of the pad that would otherwise be lost during the CMP processing. The pad conditioner 17 carries an abrasive pad that may include, for example, diamond abrasive. A wafer carrier 21 is shown with a downforce applied. The wafer carrier 21 mounts a wafer 31, usually initially by means of a vacuum, for example, and is typically oriented with the active surface of the wafer face down. The downforce holds the wafer in surface contact with the pad 15 during processing. The wafer carrier 21 may rotate about its central axis as shown, and may also oscillate in a back and forth motion. Pad conditioner 17 may also travel in an X-Y direction to condition different portions of the rotating polishing pad 15. Pad conditioner 17 may be used even during processing of a wafer, or without the wafer present.

During processing, the polishing pad 15, which may be porous or non-porous and which comes in a variety of commercially available types optimized for planarization, dielectric removal, copper removal, etc., is rotated. The slurry 23 is dispensed onto the pad 15. Wafer carrier 21 is placed into position with an active or face surface of the wafer facing and contacting the uppermost surface of the pad. If needed, a positive downforce is applied to force the face surface of the semiconductor wafer 31 onto the pad 15 and so place the wafer surface in contact with the abrasive slurry.

As shown in FIG. 1, as the wafer 31 is polished, hard particles 25 may be present. A hard particle is one that can scratch a wafer. For example a piece of diamond form the pad conditioner 17 may be present, or as the pad 15 wears, some piece of the pad 15 may break off. Since the wafer has films formed on the surface, a hard particle, for this discussion, is one that may cause wafer scratches—that is, a particle harder than typical films found on the wafer. For example, Cu film hardness is 7, Si oxide film is 6-7, both in Mohs scale, so a hard particle has a hardness greater than 6-7 on the Mohs scale. These particles might become lodged between the wafer and the pad and if the particles are sufficiently hard and large, they can cause scratches in the surface of the wafer 31. These hard particles may be from nanometer to micron diameter size, depending on the source. The wafer scratches caused by the hard particles may further cause defects in the integrated circuits being formed on the wafer 31.

Further, in conventional CMP processing the wafer scratch defects may not be detected until many more process steps are performed, and then a visual or automated scan of the wafer may reveal these defects. In an example process, after shallow trench isolation (STI) CMP, a wafer scan is not performed until a later layer of SiN or other dielectric is completed. This step occurs many hours later in the flow. Wafer scratches that occur in the STI CMP process are not detected until the first damaged wafer reaches the inspection stage. Many wafers may be processed at CMP during this time period. In one example, 400 pieces are processed at the STI CMP stage in a 24 hour period. The first wafer scratch defect is detected after 8 hours of additional time elapses. By dividing a day into three 8 hour portions, it can be seen that, taking 400/3, approximately 130-140 pieces are processed after the scratches start—and before the problem is detected. These wafers may all be as damaged as was the first one that was scratched. Thus, many materials, and processing time, are wasted on hundreds of wafer that have scratches and may not yield any functioning devices.

Figure 2:
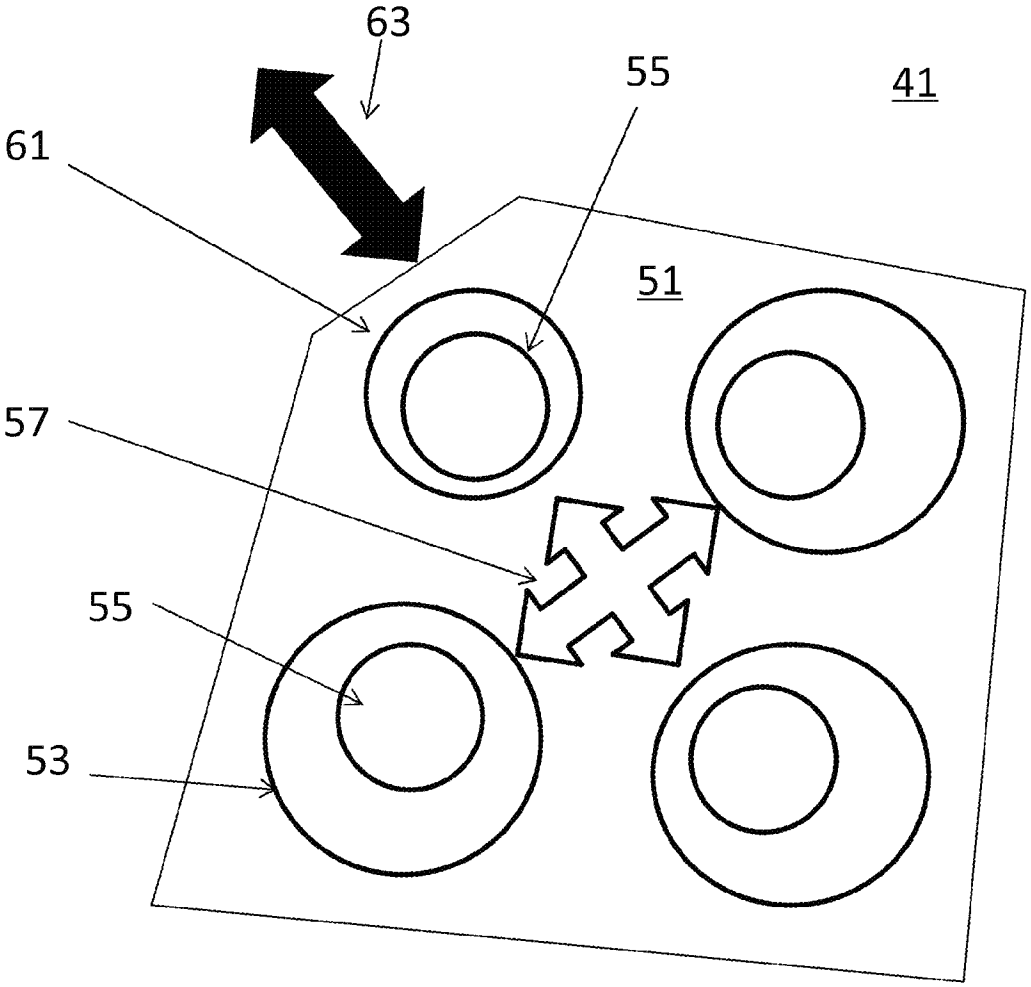
FIG. 2 depicts in a plan view a multi-platen CMP tool compatible with the embodiments.

FIG. 2 depicts in an overhead view a multiple platen CMP tool 51 that may be used with the embodiments. In FIG. 2, three platens 53 are shown arranged in an automated CMP tool 41. A tool could have 2 platens, 1 platen, and of course more than 3 is possible. A loading handler (sometimes called a "head clean load/unload" or "HCLU") 61 receives and delivers wafers from cassettes or carriers as shown by arrow 63. A wafer handler or robot arm 57 inside the tool 41 can deliver and receive semiconductor wafers 55 from the HCLU 61 and to and from each one of three platens 53. The three CMP platens 53 can simultaneously provide CMP processing on the wafers 55. In different embodiments the three platens could all perform an identical CMP process in parallel fashion, increasing the throughput of the tool; alternatively the three platens could perform sequential CMP processes, for example, the abrasive slurry could be varied from one platen to the next and a wafer could move from a coarse abrasive process to a finer one by being processed at each of the three platens in series. In any event, each of the platens in FIG. 2 may appear generally as the CMP station 11 in FIG. 1.

Figure 3:
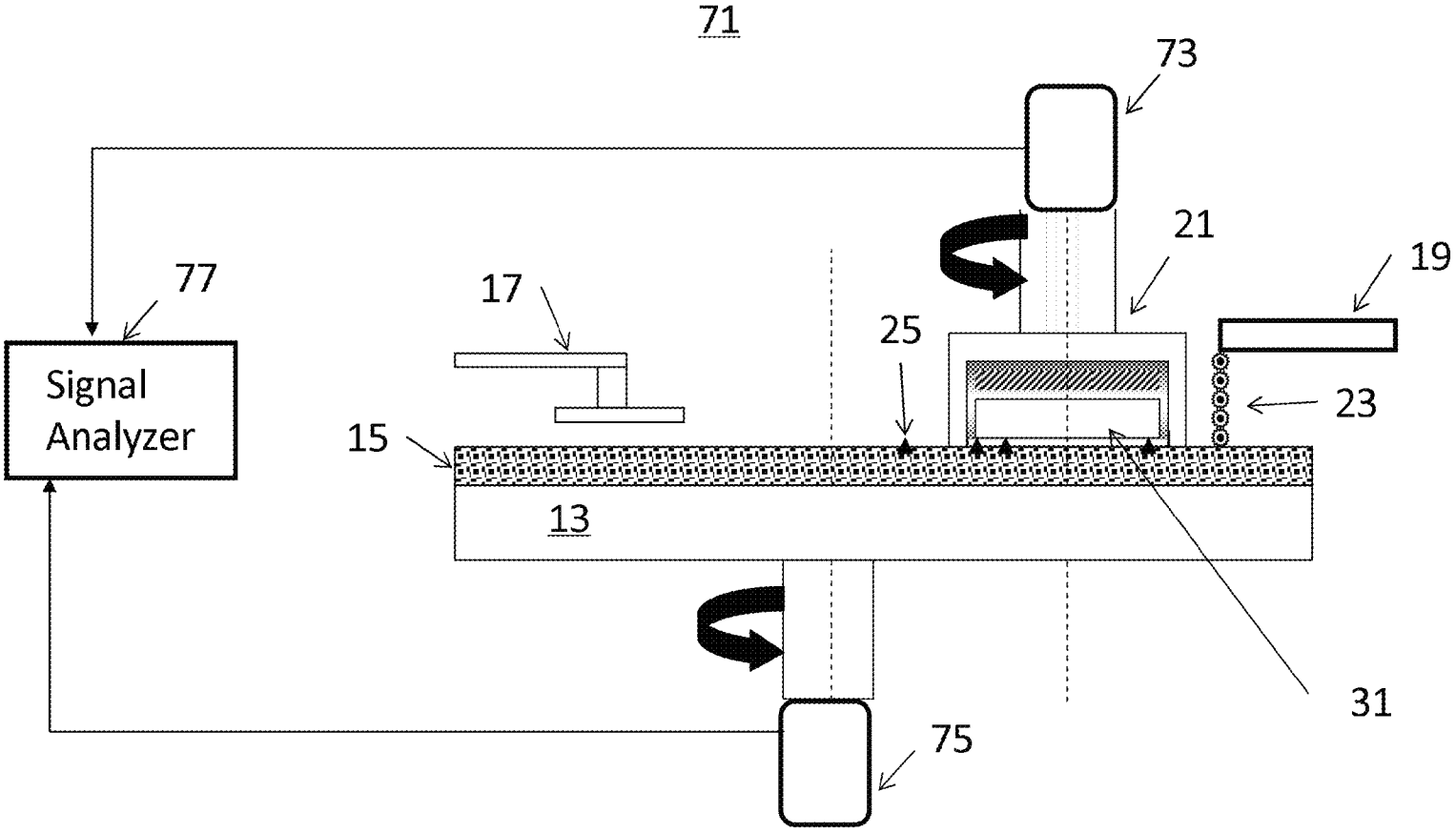
FIG. 3 depicts in a cross-sectional view a CMP tool illustrating an example embodiment.

FIG. 3 depicts in a cross-section a CMP processing tool 71 that incorporates an embodiment. The platen 13, pad 15, conditioner 17, wafer carrier 21, and slurry source 19 are arranged as before. The wafer carrier 21 carries a semiconductor wafer 31 and places the face surface of the wafer 31 in contact with the pad 15; also arranged as before. In addition, sensors 73 and 75 are attached to the platen 13 and the wafer carrier 21. These sensors are coupled to a signal analyzer 77.

If the hard particles 25 are lodged between wafer 31 and the pad 15, as shown in FIG. 3, vibration will occur. The sensors 73 and 75 sense this vibration. If the sensed vibration exceeds a predetermined threshold over the vibration observed during normal or proper CMP operations, an abnormal condition is detected. Detection may, in an example embodiment, be done by visual inspection of a signal waveform displayed by the signal analyzer. In other embodiments, as further described below, an automated comparison and detection may be performed by the signal analyzer 77. Vibration may be detected by sensing other physical phenomenon other embodiments, including pressure, acoustics, optical characteristics such as refraction and reflection, temperature etc. In the non-limiting example embodiments presented in detail here for illustrative purposes, vibration is sensed.

While the detected vibration certainly may correspond to the presence of hard particles on the CMP pad, other abnormal conditions may also be detected by use of the embodiments. These include, for example and without limiting the embodiments, an unsmooth polishing speed, inconsistent slurry caused by the dispenser or other mechanical problem, abnormal slurry or absence of slurry, machine failure in an motor or spindle, etc. Any of these conditions may also cause the vibration. The embodiments provide an alarm on an abnormal condition. Thus the embodiments, in addition to preventing or detecting wafer scratching, may detect many other conditions as they occur and therefore improve efficiency.

The vibration sensors may be commercially available piezoelectric sensors for displacement, velocity, or acceleration. In alternative embodiments the sensors may be accelerometers such as are increasingly used in handheld devices to detect motion and acceleration, for example. MEMS accelerometers or other semiconductor accelerometers may be used. Piezoelectric sensors for vibration are also commercially available and may be used with the embodiments.

Figure 4:
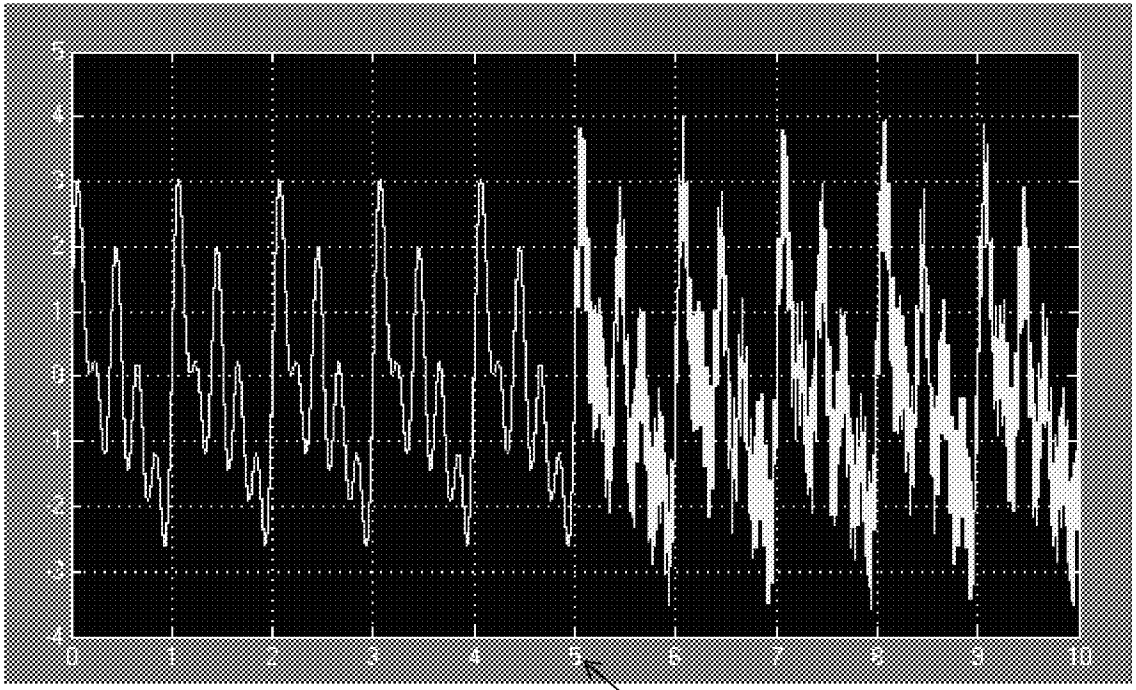
FIG. 4 depicts in a signal waveform signals in the time domain for use with an embodiment.

In an embodiment, the signal analyzer 77 can collect time domain information. For example, FIG. 4 depicts an amplitude-time sample for a CMP process starting in a normal mode. At time 5 a vibration, such as is caused by a hard particle problem, begins. As can be clearly seen from the amplitude v. Time trace of FIG. 4, the waveform changes noticeably when the vibration begins at a time labeled "81". In an embodiment, the signal analyzer can further compare the signal waveform to a "normal" waveform, such as one from a stored signal template, and when the comparison indicates that a vibration exceeds a predetermined threshold value, automatically signal an alarm or abnormal condition. Alternatively the signal analyzer output could be monitored visually by an operator by simple visual inspection of the time domain output. Advantageously, the vibration may be detected real time during the CMP process. The comparison can be made continuously, or periodically, during CMP processing. In an embodiment the CMP tool and the process can be halted when an abnormal condition is detected. In some cases the damage may be remediated, for example, by removing the hard particles prior to continuing the CMP processing. If the problem cannot be solved for the particular wafer in process, that wafer can be removed from further processing, saving time and materials that would be otherwise wasted. Once the CMP tool is cleaned and ready, additional wafers can be processed without the wafer scratching caused by the hard particles.

Figure 5A:
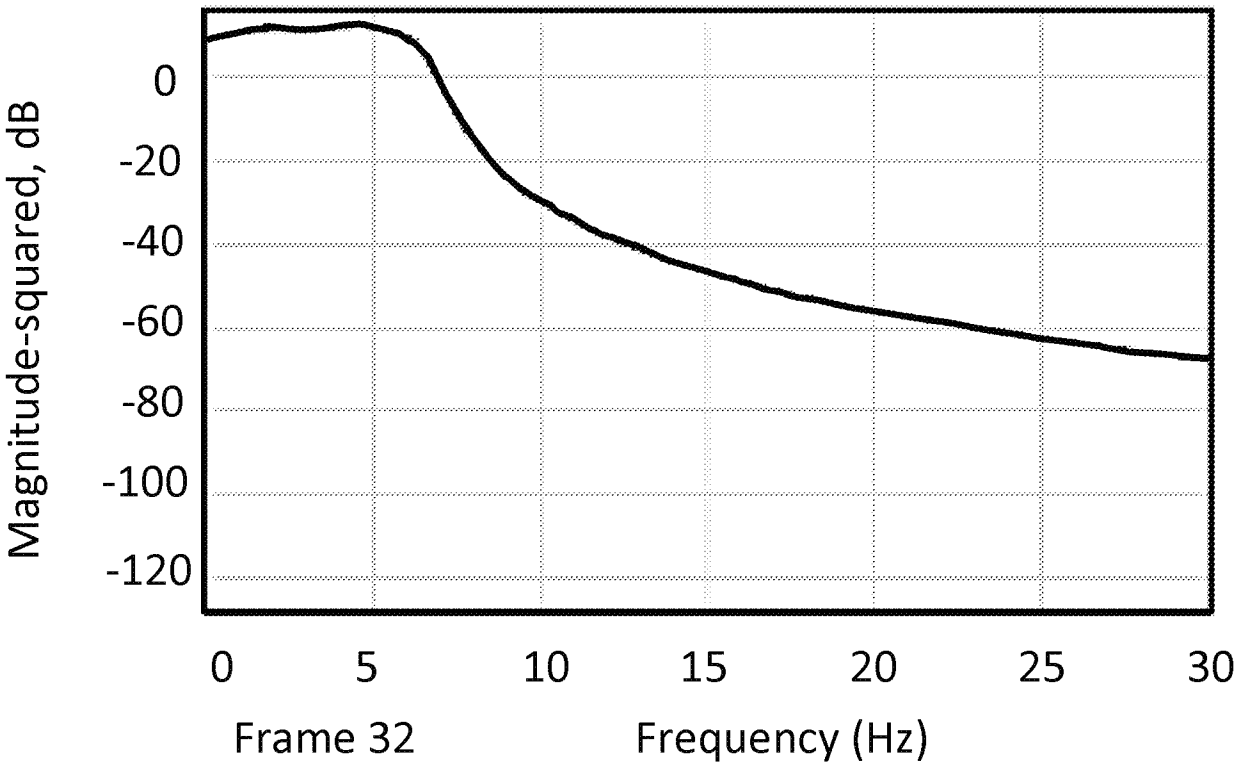
FIG. 5A depicts in a signal waveform a frequency domain transform of a signal for use with an embodiment.
Figure 5B:
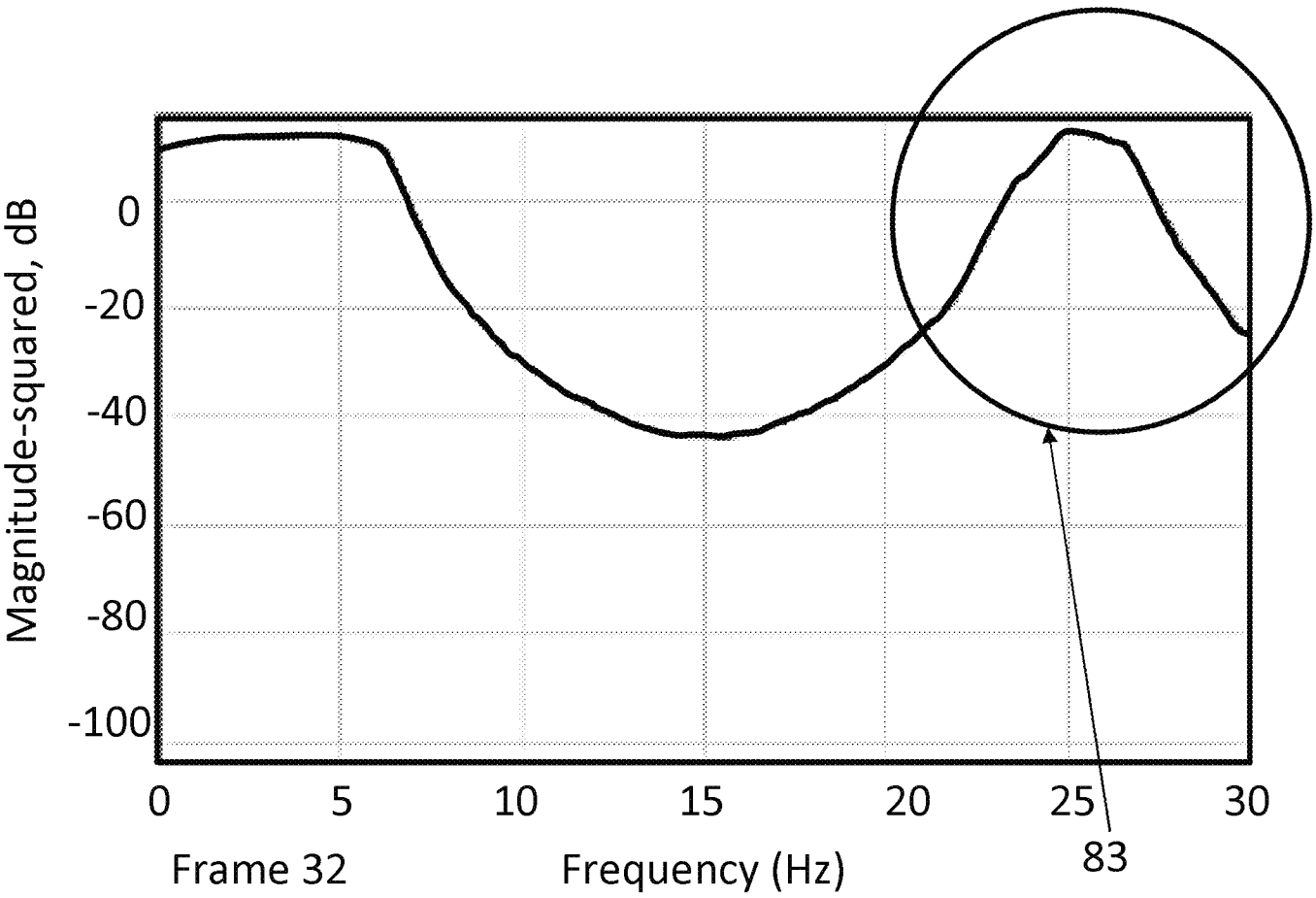
FIG. 5B depicts in a signal waveform another frequency domain transform of a signal for use with an embodiment.

In an alternative embodiment, additional signal processing is performed. FIGS. 5A and 5B depict, for the vibration sensing example, a pair of frequency domain transform outputs plotted for the time analysis signal waveform of FIG. 4. In this example, a fast Fourier transform ("FFT") is used, although other frequency domain transforms could be used. In FIG. 5A, the normal part of the signal trace of FIG. 4 is shown in a frequency domain transform signal waveform. In FIG. 5B, the abnormal part of the time trace of FIG. 4 is shown in the frequency domain. A change in magnitude response between frequency 20-30 Hz in FIG. 5B labeled "83" clearly is not present in FIG. 5A. This change corresponds to the occurrence of a different vibration mode; so again by comparing normal operation frequency domain transform samples to the real time signal frequency domain transform sample, the signal analyzer can detect a vibration and signal an alarm indicting an abnormal condition exists. In an alternative embodiment, visual inspection of the output of the frequency domain transform could also be performed by an operator. The method can further be extended to stop the processing entirely, or, set an alarm indicating an out of normal condition at the CMP tool.

As is noted above some CMP tools have multiple platens, such as illustrated in FIG. 2. In an embodiment, each platen in such a tool could have an individual signal analyzer 77 and multiple sensors 73, 75 to perform the vibration detection as described above. In another embodiment, a multiplexer at the input of a single signal analyzer could receive a pair of signals from each platen stage. In a time sharing operation, the signal analyzer could output comparison results for the selected CMP platen, and then sample data for another platen. In this manner, only a single signal analyzer is needed for the tool, with time multiplexed input signals and corresponding output signals. Other variations on this arrangement form alternative contemplated embodiments for this embodiment that are within the scope of the appended claims.

Figure 6:
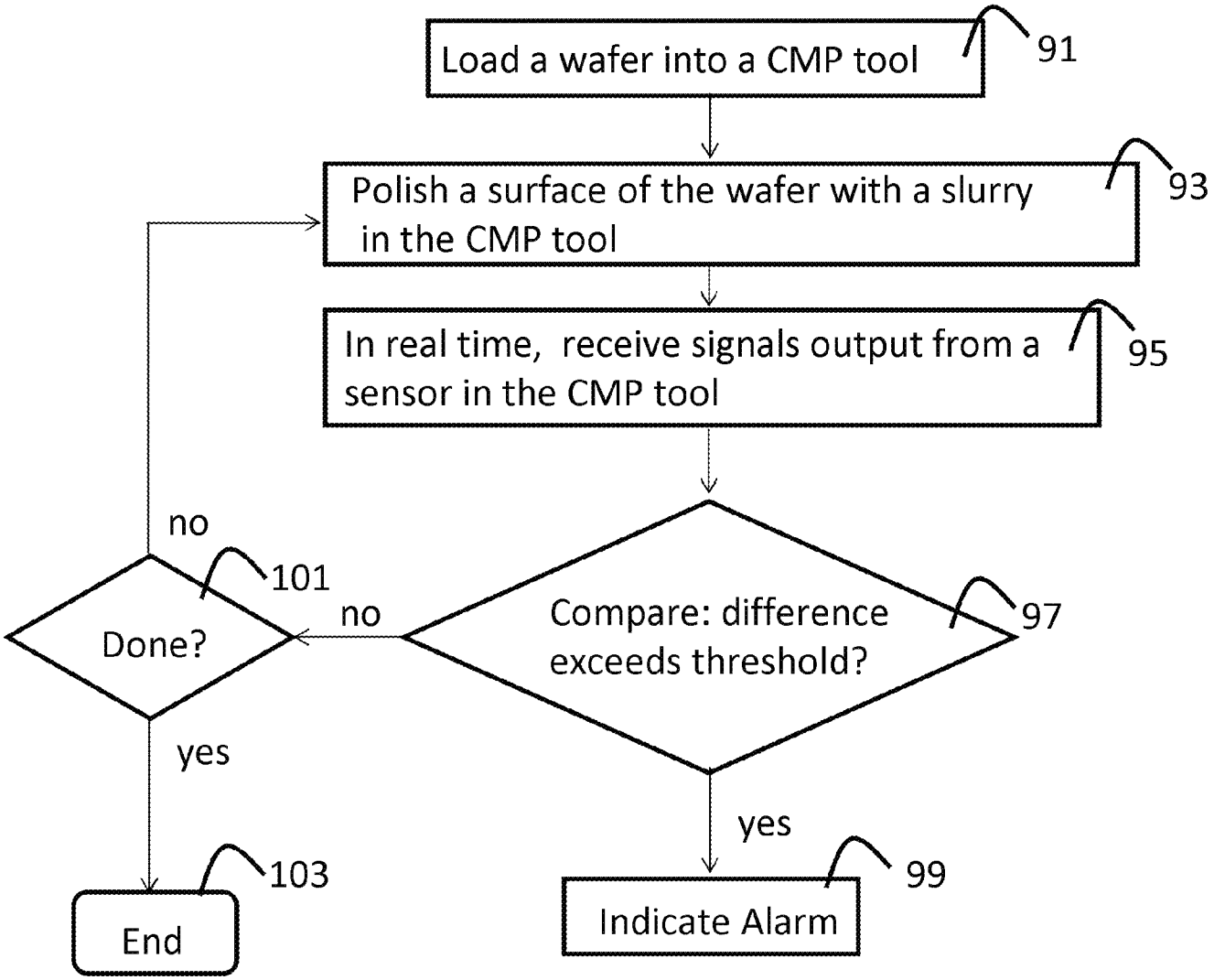
FIG. 6 depicts in a process flow diagram an example method embodiment.

FIG. 6 depicts in a flow diagram an example method embodiment. In state 91, a wafer is loaded into a CMP tool. In state 93, a surface of the wafer is polished with slurry in the CMP tool. In state 95, in real time, output signals are received from the sensors in the CMP tool. In state 97, a comparison is performed. In an example embodiment, the comparison may simply entail visual inspection of an output waveform, visually comparing the output to a normal or expected signal output for the CMP tool.

In other embodiments, the comparison may involve capturing a signal sample in a signal analyzer, as described above. The captured signal corresponding to the received signal is compared to an expected output signal for normal conditions. The expected output signal may be retrieved from stored signal templates, for example. These may be stored in a memory device, hard disk drive, EEPROM or flash, commodity memory or the like coupled to the signal analyzer or even provided as part of the signal analyzer. If the difference between the real time received signal and the expected normal signal exceeds a predetermined threshold, an alarm can be indicated as is shown in state 99. In a further embodiment, the CMP processing in the tool could be automatically halted. If the compare at state 97 is false, which indicates the threshold is not exceeded, the method determines if more processing is needed at state 101, and if that is true, returns to state 93. If the wafer processing is done, then the method ends at state 103.

Figure 7:
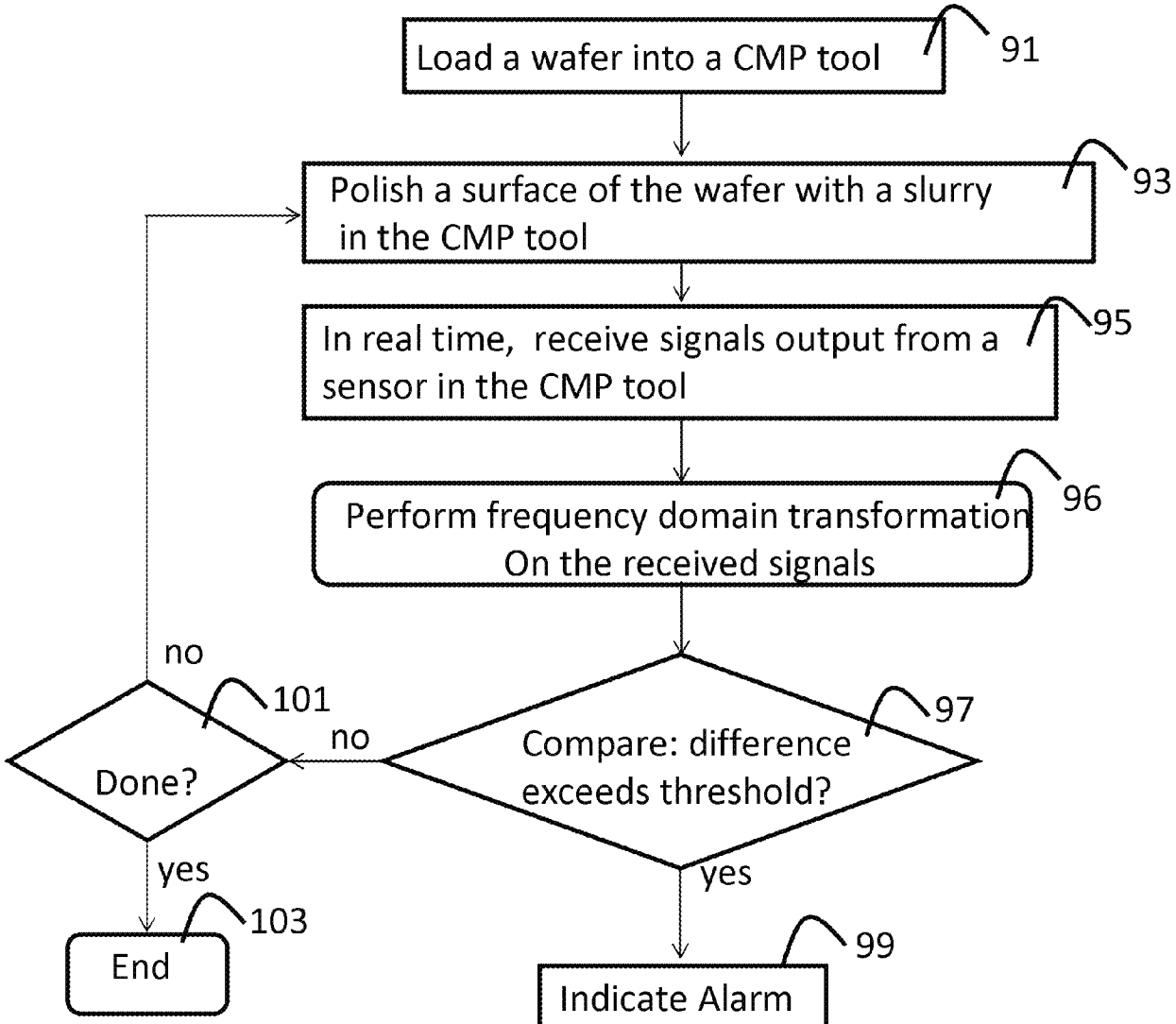
FIG. 7 depicts in a process flow diagram an alternative method embodiment.

FIG. 7 depicts in a flow diagram another alternative method embodiment. In FIG. 7, the states for 91, 93, and 95 are the same as described above for FIG. 6. State 96 is a further state where a frequency domain transformation, such as an FFT or discrete cosine transform ("DCT") is performed on the received signals. In state 97 a comparison is performed on the frequency domain transform signals. Again, as described above, in one example embodiment, this comparison may be done by visual inspection of a waveform display, comparing the current received signal as a frequency domain transform to a normal received signal frequency transform for the CMP tool. In another further alternative embodiment, the comparison process is automated. A comparison is performed by determining a difference between a stored normal frequency domain signal corresponding to normal output signals received from the sensors, this is compared to the current frequency domain signal corresponding to the received output from the sensors. The stored normal output signals may be stored in a memory device that is accessed by a signal analyzer, for example. If the difference between the frequency domain transform signals exceeds a predetermined threshold, the method transitions to state 99 and the alarm is indicated. If the comparison is false, the method transitions to state 101, and if more processing is needed, returns to state 93. If on the other hand the processing for the wafer is ended, the method leaves state 101 and ends at state 103.

In the embodiments above, the signal analyzer may be provided as a commercially available device. Alternatively, the signal analyzer could be provided by programming a programmable microprocessor, processor, or computer. The signal analyzer may include a non-transitory memory for storing normal signal templates corresponding to output signals received from the sensors during normal CMP tool operations, and a memory or store such as a buffer for storing the real time signals received from the CMP tool. A comparator could be formed as an ASIC or IC; or it may be implemented using software to program the microprocessor or computer. Various implementations within the skill of one skilled in the art could be done, using for example programming complex programmable logic devices such as CPLDs, FPGAs and the like, EEPROMs or FLASH devices may be used for program and data stores, and digital signal processors (DSPs), or ASICS could be used. Display circuitry including video frame buffers and the like may be used to provide a visually readable waveform output for a human operator to inspect. All of these implementations are contemplated as alternative embodiments to the above described embodiments and fall within the scope of the appended claims.

In an embodiment, an method includes disposing a semiconductor wafer onto a wafer carrier in a tool for chemical mechanical polishing ("CMP"); positioning the wafer carrier so that a surface of the semiconductor wafer contacts a polishing pad mounted on a rotating platen; and dispensing an abrasive slurry onto the rotating polishing pad, while maintaining the surface of the semiconductor wafer in contact with the polishing pad to perform a CMP process on the semiconductor wafer. In real time, signals are received from the CMP tool into a signal analyzer, the signals corresponding to one of vibration, acoustics, temperature, and pressure. The method continues by comparing the received signals from the CMP tool to expected received signals for normal processing by the CMP tool; and outputting a result of the comparing. In an alternative embodiment, the method continues by indicating an alarm condition when the comparison indicates that a difference between the received signal and the expected signal exceeds a predetermined threshold. In a further embodiment, the method continues by outputting a human readable visual display for inspection by an operator. In still a further embodiment, the method continues by doing the comparison by performing a frequency domain transform on the received signals, and outputting a human readable visual display of the frequency domain transform for inspection by an operator. In yet another embodiment, the method includes receiving signals from at least one vibration sensor in the CMP tool. In another alternative, the method includes receiving signals from a vibration sensor coupled to the rotating platen. In still another alternative, receiving signals further comprises receiving signal from a vibration sensor mounted on the wafer carrier. In yet another alternative, the method includes performing a frequency domain transform on the received signals; comparing the frequency domain transform of the received signals to a stored frequency domain transform for an expected received signal for normal processing; and indicating, based on the compare of the frequency domain signals, when the received signal differs from the expected received signal by an amount more than a predetermined threshold. In a further alternative, the method includes stopping the CMP process based on the comparing. In yet another alternative, the method is performed and the received signals are received from at least one vibration sensor when a hard particle causes abnormal vibration in the CMP tool.

In an embodiment, an apparatus is provided including a rotating platen supporting a chemical mechanical polish ("CMP") pad in a CMP tool; a wafer carrier configured to position a surface of a semiconductor in contact with the surface of the CMP pad; a slurry dispenser configured to supply slurry to the CMP polishing pad; at least one sensor coupled to the CMP tool and having a signal output, the sensor providing signals corresponding to one of vibration, acoustics, temperature, and pressure; and a signal analyzer is coupled to receive the signal output of the at least one sensor, and configured to output an alarm when an abnormal condition exists. In a further embodiment, the apparatus includes the signal analyzer which further includes a store of expected output signals corresponding to a normal process condition in the CMP tool; and a comparator configured to compare the received signal output from the at least one sensor to a stored expected signal and to indicate an alarm when the difference exceeds a predetermined threshold. In another embodiment, the signal analyzer further includes a human readable visual display for displaying the received signal. In yet another embodiment the signal analyzer further includes a frequency domain transformation apparatus configured to perform a frequency domain transformation on the received signal. In still another embodiment, the at least one sensor includes a vibration sensor coupled to one of the rotating platen and the wafer carrier. In a further embodiment, the apparatus includes a vibration sensor that is one of an accelerometer and a piezoelectric vibration detector.

In yet another alternative embodiment, a method is provided for sensing a hard particle in a chemical mechanical polish ("CMP") process. The method includes disposing a semiconductor wafer onto a wafer carrier in a tool for CMP; positioning the wafer carrier so that a surface of the semiconductor wafer contacts a surface of a polishing pad mounted on a rotating platen; dispensing an abrasive slurry onto the rotating polishing pad while maintaining the surface of the semiconductor wafer in contact with the polishing pad; in real time, receiving signals from the CMP tool into a signal analyzer, the signals corresponding to vibration sensed in the CMP tool; and comparing the received signals from the CMP tool to expected received signals for normal processing by the CMP tool. When the comparing indicates a difference between the received signals and the expected received signal that exceeds a predetermined threshold that corresponds to the presence of a hard particle on the polishing pad, the method continues by outputting an alarm. In a further alternative embodiment, the method further comprises stopping the CMP tool upon outputting the alarm. In still another embodiment, comparing the received signals further includes performing frequency domain transformation for the received signals, and the comparing further comprises comparing the frequency domain transformation for the received signals to a stored frequency domain transformation of an expected signal for normal processing by the CMP tool. In yet another alternative for this embodiment, receiving signals from the CMP tool further includes receiving signals from a vibration sensor mounted on the wafer carrier, and receiving signals from another vibration sensor mounted on the rotating platen.

The scope of the present application is not intended to be limited to the particular illustrative embodiments of the structures, methods and steps described in the specification. As one of ordinary skill in the art will readily appreciate from the disclosure of the present invention, processes, or steps, presently existing or later to be developed, that perform substantially the same function or achieve substantially the same result as the corresponding embodiments described herein may be utilized according to the present invention. Accordingly, the appended claims are intended to include within their scope such processes or steps.

What is claimed is:

1. A method, comprising:

disposing a first semiconductor wafer onto a wafer carrier in a tool for chemical mechanical polishing ("CMP");

positioning the wafer carrier so that a surface of the first semiconductor wafer contacts a polishing pad mounted on a first rotating platen;

dispensing an abrasive slurry onto the polishing pad while maintaining the surface of the first semiconductor wafer in contact with the polishing pad to perform a CMP process on the first semiconductor wafer;

selecting the first rotating platen of the CMP tool with a multiplexer at an input of a signal analyzer;

receiving signals from the first rotating platen of the CMP tool into the signal analyzer, the signals being derived from at least one vibration sensor on the first rotating platen, the at least one vibration sensor comprising an accelerometer;

comparing the received signals from the first rotating platen of the CMP tool to expected received signals for normal processing by the first rotating platen of the CMP tool, while selecting a second rotating platen of the CMP tool with the multiplexer and receiving signals from the second rotating platen of the CMP tool, the second rotating platen contacting a second semiconductor wafer, the second rotating platen comprising at least one accelerometer; and outputting a result of the comparing.

2. The method of claim 1, and further comprising:

based on the comparing, indicating an alarm condition when a difference between the received signals from the CMP tool and the expected received signals exceeds a predetermined threshold.

3. The method of claim 2, and further comprising:

performing a frequency domain transform on the received signals from the CMP tool;

comparing the frequency domain transform of the received signals from the CMP tool to a stored frequency domain transform for the expected received signals for normal processing; and indicating, based on the result of the comparing, when the received signals from the CMP tool differ from the expected received signals by an amount more than a predetermined threshold.

4. The method of claim 2, further comprising stopping the CMP process based on the step of comparing.

5. The method of claim 1, wherein the step of outputting the result of the comparing comprises outputting a human readable visual display for inspection by an operator.

6. The method of claim 1, wherein the step of outputting a result of the comparing comprises performing a frequency domain transform on the received signals from the CMP tool, and outputting a human readable visual display of the frequency domain transform for inspection by an operator.

7. The method of claim 1, wherein the at least one vibration sensor is on the wafer carrier.

8. The method of claim 1, wherein the at least one vibration sensor is a plurality of vibration sensors.

9. The method of claim 1, wherein the at least one vibration sensor includes a first vibration sensor on the wafer carrier and a second vibration sensor on the first rotating platen.

10. A method for sensing a hard particle in a chemical mechanical polish ("CMP") process, comprising:

disposing a first semiconductor wafer onto a wafer carrier in a tool for CMP;

positioning the wafer carrier so that a surface of the first semiconductor wafer contacts a surface of a polishing pad mounted on a first rotating platen;

selecting the first rotating platen with a multiplexer at an input of a signal analyzer;

dispensing an abrasive slurry onto the polishing pad while maintaining the surface of the first semiconductor wafer in contact with the polishing pad;

receiving signals from the first rotating platen of the CMP tool into the signal analyzer, the received signals corresponding to vibration sensed by at least one vibration sensor on the first rotating platen, the at least one vibration sensor comprising an accelerometer;

comparing the received signals from the first rotating platen of the CMP tool to expected received signals for normal processing by the first rotating platen of the CMP tool, while receiving signals from a second rotating platen of the CMP tool, the second rotating platen selected with the multiplexer, the second rotating platen contacting a second semiconductor wafer, the second rotating platen comprising at least one accelerometer; and when the comparing indicates a difference between the received signals and the expected received signals exceeds a predetermined threshold that corresponds to a presence of a hard particle on the polishing pad, outputting an alarm.

11. The method of claim 10, and further comprising stopping the CMP tool upon outputting the alarm.

12. The method of claim 10, wherein the step of comparing the received signals from the CMP tool further comprises performing frequency domain transformation for the received signals from the CMP tool, and the step of comparing further comprises comparing the frequency domain transformation for the received signals from the CMP tool to a stored frequency domain transformation of an expected signal for normal processing by the CMP tool.

13. The method of claim 10, wherein the at least one vibration sensor is mounted on the wafer carrier.

14. The method of claim 13, and wherein the step of receiving signals from the CMP tool further comprises:

receiving signals from another vibration sensor mounted on the first rotating platen.

15. A method, comprising:

performing chemical mechanical polish (CMP) processes on a first workpiece and a second workpiece simultaneously;

selecting the first workpiece with a multiplexer;

detecting a first condition of the CMP processes using a first vibration sensor, the vibration sensor comprising an accelerometer;

comparing the first condition of the CMP processes to an expected condition during first time periods of the CMP processes;

selecting the second workpiece with a multiplexer;

detecting a second condition of the CMP processes using a second vibration sensor;

comparing the second condition of the CMP processes to a second expected condition during second time periods of the CMP processes, wherein the first and second time periods are interleaved; and generating an alarm condition when the detected condition deviates from the expected condition by a predetermined threshold.

16. The method of claim 15, wherein the step of comparing the condition to an expected condition includes:

converting the condition to a signal;

performing a frequency domain transform on the signal;

comparing the frequency domain transform of the signal to a stored frequency domain transform for an expected signal; and indicating, based on the step of comparing the frequency domain transform of the signal to a stored frequency domain transform for an expected signal, when the condition of the CMP process differs from the expected condition by an amount more than a predetermined threshold.

17. The method of claim 15, further including stopping the CMP process in response to the alarm condition.

18. The method of claim 15, further comprising conditioning a polishing pad used in the CMP process in response to the alarm condition.

* * * * *